US006375110B1

(12) United States Patent
Ofer et al.

(10) Patent No.: US 6,375,110 B1
(45) Date of Patent: Apr. 23, 2002

(54) UNIVERSAL WHEEL OPERATED WINCH

(76) Inventors: Hovav Ofer, Moshav Sdo Nltzan, 85470; Yaakov Regev, Moshav Dekel, 85492, both of (IL)

( * ) Notice: Subject to any disclaimer, the term of this patent is extended or adjusted under 35 U.S.C. 154(b) by 0 days.

(21) Appl. No.: 09/618,464

(22) Filed: Jul. 18, 2000

(51) Int. Cl.[7] ..... B65H 75/48
(52) U.S. Cl. ..... 242/392
(58) Field of Search ..... 242/392; 254/323, 254/325, 328; 180/7.5, 53.61

(56) References Cited

U.S. PATENT DOCUMENTS

| | | | | | |
|---|---|---|---|---|---|
| 1,287,620 | A | * | 12/1918 | Benson | 242/392 |
| 1,321,366 | A | * | 11/1919 | Davis | 242/392 |
| 1,462,811 | A | * | 7/1923 | Johnson | 242/392 |
| 1,463,022 | A | | 7/1923 | Sepelyak | |
| 1,469,506 | A | * | 10/1923 | Gillam | 242/392 |
| 1,498,107 | A | * | 6/1924 | Montgomery | 242/392 |
| 1,504,056 | A | * | 8/1924 | Kilkenny | 242/392 |
| 1,528,058 | A | | 3/1925 | Hobson | |
| 2,240,570 | A | | 5/1941 | Oesterheld | |
| 2,377,881 | A | | 6/1945 | Hans | |
| 2,751,193 | A | * | 6/1956 | Loomis | 242/392 |
| 3,132,823 | A | * | 5/1964 | Domines | 242/392 |
| 3,292,905 | A | * | 12/1966 | McCain | 242/392 |
| 4,135,681 | A | | 1/1979 | Cooper | |
| 4,291,847 | A | | 9/1981 | Gilbert | |
| 4,568,036 | A | | 2/1986 | Kearney | |
| 4,742,971 | A | | 5/1988 | Wallace | |
| 4,767,081 | A | | 8/1988 | Lau | |
| 4,778,126 | A | | 10/1988 | Spann | |
| 4,836,466 | A | | 6/1989 | Peterson | |
| 5,115,994 | A | | 5/1992 | Hershberger | |
| 5,890,671 | A | * | 4/1999 | Meloy | 242/392 |

* cited by examiner

*Primary Examiner*—William A. Rivera
(74) *Attorney, Agent, or Firm*—Mark M. Friedman

(57) ABSTRACT

A universal wheel operated winch includes a drum with a cylindrical outer surface for receiving a cable wound thereupon, and at least three rigid arms, each adjustably associated with the drum. Each arm terminates in an end portion configured to engage an edge of an aperture in a wheel hub. The adjustability of the arms allows adjustment of a radial distance from the central axis of the drum to the end portion, thereby accommodating wheel hub apertures with differing radial spacing. The winch preferably also offers adjustability as to the angular spacing of the arms about the axis.

21 Claims, 7 Drawing Sheets

UNIVERSAL WHEEL OPERATED WINCH

FIELD AND BACKGROUND OF THE INVENTION

The present invention relates to wheel operated winches and, in particular, it concerns a universal wheel operated winch which can readily be connected to the wheels of substantially any modern motor vehicle.

It is a well recognized problem that motor vehicles often become stuck in soft terrain, such as in mud, sand, snow and the like, where the wheels cannot provide sufficient traction to extract the vehicle. Some purpose-built "all-terrain" vehicles are provided with a dedicated winch for this purpose, but such winches add greatly to the cost of the vehicle and are therefore not widely used.

As long ago as 1923, it was proposed that a motor vehicle could draw itself out of such situations by temporarily attaching a winch drum to the vehicle wheels. Thus the rotation of the wheels which is insufficient to extract the vehicle directly can instead be used to turn the winch. Numerous proposed implementations of this concept may be found in U.S. Pat. No. 1,463,022 to Sepelyak, U.S. Pat. No. 2,240,570 to Oesterheld, U.S. Pat. No. 2,377,881 to Hans, U.S. Pat. No. 4,1135,681 to Cooper, U.S. Pat. No. 4,291,847 to Gilbert, U.S. Pat. No. 4,568,036 to Kearney, U.S. Pat. No. 4,742,971 to Wallace et al., U.S. Pat. No. 4,767,081 to Lau, U.S. Pat. No. 4,778,126 to Spann, U.S. Pat. Nos. 4,836,466 to Peterson and 5,115,994 to Hershberger.

In most of the aforementioned examples, attachment of the winch assembly is a painstaking process involving removal of the bolts securing the wheels and bolting of the winch assembly in place. In the few examples which are easier to attach, the design requires special modification of the wheel itself, or is highly specific to a non-standard wheel design.

One exception to these shortcomings was proposed in U.S. Pat. No. 1,528,058 to Hobson. Here, a winch drum has a square flange with a T-shaped bracket projecting from each comer to engage spokes of a wheel. The device is centered by engagement of a small central hub of the wheel within a central hole in the square flange. This design allows instant fitting of the winch assembly which locks itself by engagement of the T-shaped brackets with the spokes as soon as tension is applied to the cable.

Although the Hobson design offers an advantageous solution for wheels with radial spokes of the type which was apparently prevalent in the 1920's, it is not readily applicable to modern vehicle wheels. Modern vehicle wheels do not have a knob-like projecting central hub which could be used for centering the device on the wheel. Additionally, modern wheels vary greatly as to the radial positioning and angular spacing of the relatively small openings such that the T-shaped brackets of Hobson, of correctly positioned for a particular wheel design, would not be correctly positioned for the vast majority of other wheels. Furthermore, many modem wheels have non-rectangular arrangements of openings, such as three, five or seven openings spread around the wheel. The rectangular arrangement of Hobson is inherently unsuitable for such cases.

There is therefore a need for a universal wheel operated winch assembly which could rapidly be fit to substantially any modem motor vehicle wheel with minimal labor.

SUMMARY OF THE INVENTION

The present invention is a universal wheel operated winch.

According to the teachings of the present invention there is provided, a universal wheel operated winch for convenient attachment to a wheel hub so as to draw a cable by rotation of the wheel, the universal wheel operated winch comprising: (a) a drum providing a substantially cylindrical outer surface configured for receiving a cable wound thereupon, the drum having a central axis; (b) at least three rigid arms, each terminating in an end portion configured to engage an edge of an aperture in a wheel hub, the rigid arms adjustably cooperating with the drum such that a radial distance from the end portion to the central axis may be varied; and (c) a clamping mechanism, associated with the drum, and configured to selectively clamp the rigid arms in a substantially fixed position relative to the drum.

According to a further feature of the present invention, the drum features a clamping surface provided with a plurality of substantially radial grooves angularly-spaced about the axis and configured for receiving the rigid arms, and wherein the clamping mechanism includes a clamping block deployed with a surface facing, and selectively closable towards, the clamping surface so as to clamp the rigid arms within the radial grooves.

According to a further feature of the present invention, the clamping surface is substantially conical.

According to a further feature of the present invention, the plurality of substantially radial grooves includes sets of radial grooves angularly-spaced about the axis at multiples of substantially 360°/n for at least two different integer values of n not less than 3.

According to a further feature of the present invention, each of the rigid arms has a substantially circular cross-section.

According to a further feature of the present invention, each of the rigid arms is mechanically linked to the drum via a pivotal connection.

According to a further feature of the present invention, the clamping mechanism is configured to impose a substantially uniform limitation on the radial distance of the end portion for each of the arms from the central axis.

According to a further feature of the present invention, the clamping mechanism is configured to displace the at least three rigid arms pivotally about the pivotal connections to positions in which the end portion for each of the arms is at least a given minimum radial distance from the central axis.

According to a further feature of the present invention, the at least three rigid arms are implemented as at least six rigid arms, the pivotal connections being configured to allow each of the rigid arms to be selectively pivoted to an inoperative position.

According to a further feature of the present invention, the at least six rigid arms includes a first group of three of the rigid arms angularly spaced at an angle of substantially 120° to each other and a second group of the four rigid arms angularly spaced at an angle of substantially 90° to each other.

According to a further feature of the present invention, the pivotal connection of at least one of the rigid arms is implemented by pivotal mounting of the rigid arm on an arcuate rod which approximates to an arc of constant radius about the central axis, the at least one rigid arm being slidable along the arcuate rod, thereby permitting adjustment of an angular spacing between at least two of the rigid arms about the central axis.

There is also provided according to the teachings of the present invention, a universal wheel operated winch for convenient attachment to a wheel hub so as to draw a cable by rotation of the wheel, the universal wheel operated winch comprising: (a) a drum providing a substantially cylindrical outer surface configured for receiving a cable wound thereupon, the drum having a central axis; and (b) at least three rigid arms, each mechanically linked via a pivotal connection to the drum and terminating in an end portion configured to engage an edge of an aperture in a wheel hub, the pivotal connection being configured such that pivoting of the rigid arm varies a radial distance from the central axis to the end portion.

According to a further feature of the present invention, there is also provided a mechanical actuator associated with the drum and configured to impose a substantially uniform limitation on the radial distance of the end portion for each of the arms from the central axis.

According to a further feature of the present invention, there is also provided a mechanical actuator associated with the drum and configured to displace the at least three rigid arms pivotally about the pivotal connections to positions in which the end portion for each of the arms is at least a given minimum radial distance from the central axis.

According to a further feature of the present invention, the at least three rigid arms are implemented as at least six rigid arms, the pivotal connections being configured to allow each of the rigid arms to be selectively pivoted to an inoperative position.

According to a further feature of the present invention, the at least six rigid arms includes a first group of three of the rigid arms angularly spaced at an angle of substantially 120° to each other and a second group of the four rigid arms angularly spaced at an angle of substantially 90° to each other.

According to a further feature of the present invention, the pivotal connection of at least one of the rigid arms is implemented by pivotal mounting of the rigid arm on an arcuate rod which approximates to an arc of constant radius about the central axis, the at least one rigid arm being slidable along the arcuate rod, thereby permitting adjustment of an angular spacing between at least two of the rigid arms about the central axis.

There is also provided according to the teachings of the present invention, a universal wheel operated winch for convenient attachment to a wheel hub so as to draw a cable by rotation of the wheel, the universal wheel operated winch comprising: (a) a drum providing a substantially cylindrical outer surface configured for receiving a cable wound thereupon, the drum having a central axis; (b) at least one arcuate rod, rigidly interconnected with the drum, the at least one arcuate rod approximating to at least one are from a virtual circle of constant radius about the central axis; and (c) at least three rigid arms mechanically linked to the drum and terminating in an end portion configured to engage an edge of an aperture in a wheel hub, at least two of the rigid arms being mounted so as to be slidable along the at least one arcuate rod, thereby permitting adjustment of an angular spacing between at least two of the rigid arms about the central axis.

According to a further feature of the present invention, each of the at least three rigid arms is mechanically linked to the drum via a pivotal connection configured such that pivoting of the rigid arm varies a radial distance from the central axis to the end portion.

According to a further feature of the present invention, there is also provided a mechanical actuator associated with the drum and configured to impose a substantially uniform limitation on the radial distance of the end portion for each of the arms from the central axis.

According to a further feature of the present invention, there is also provided a mechanical actuator associated with the drum and configured to displace the at least three rigid arms pivotally about the pivotal connections to positions in which the end portion for each of the arms is at least a given minimum radial distance from the central axis.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a universal wheel operated winch,

The principles and operation of universal wheel operated winches according to the present invention may be better understood with reference to the drawings and the accompanying description.

Figure 1:
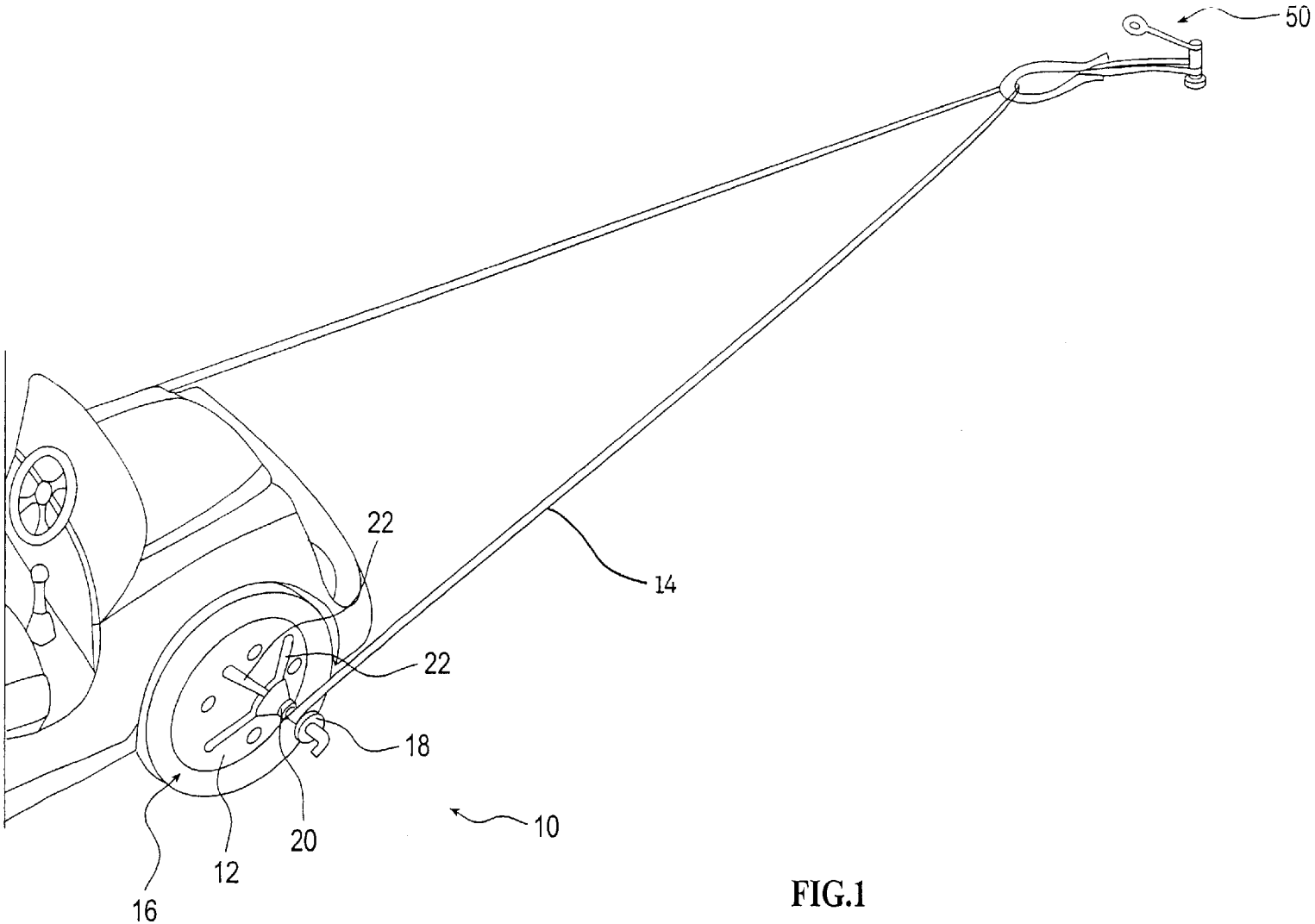
FIG. 1 is a schematic isometric view of a vehicle employing a universal wheel operated winch, constructed and operative according to the teachings of the present invention, for extracting itself from soft terrain.
Figure 2:
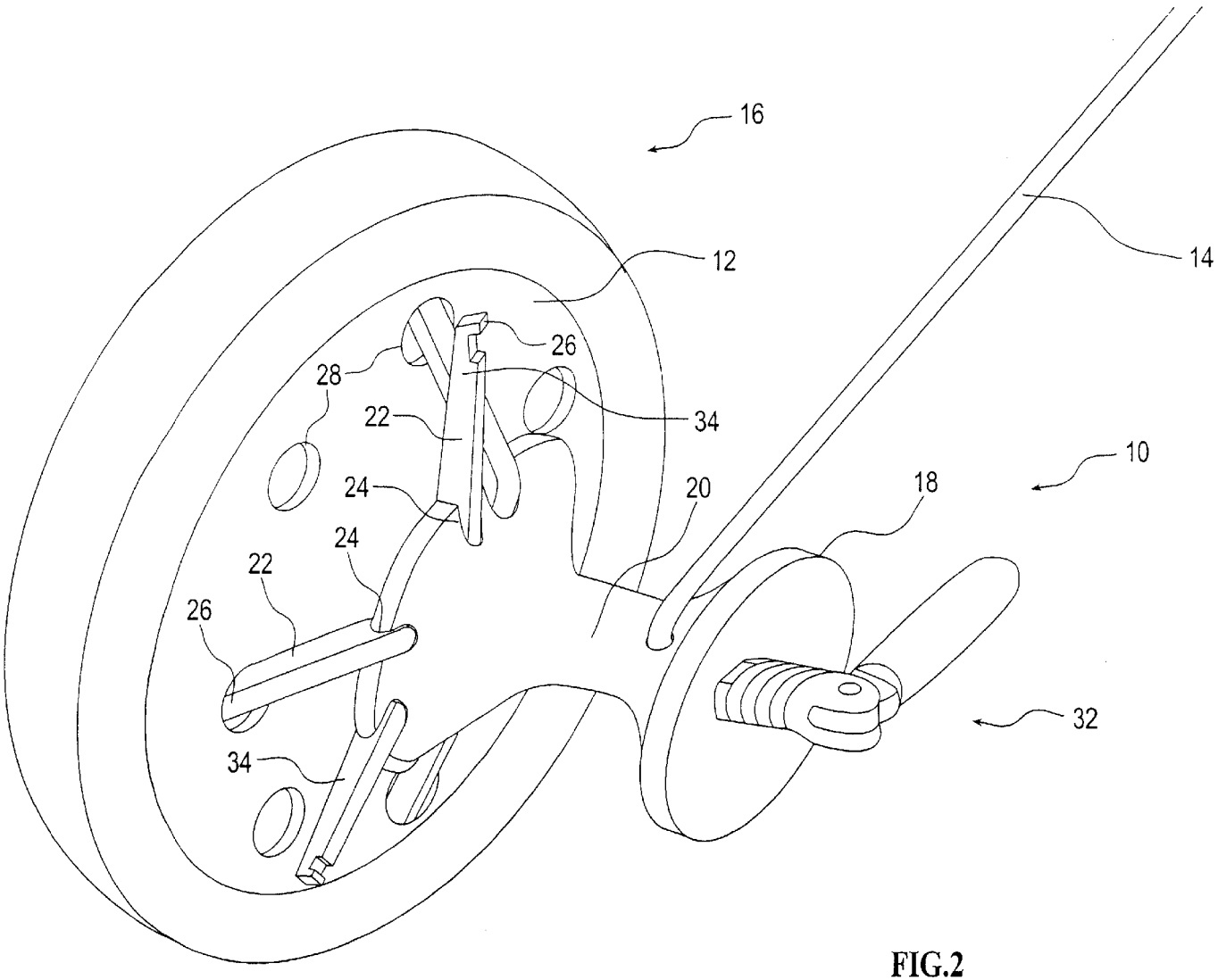
FIG. 2 is an enlarged isometric view of a portion of FIG. 1 showing the attachment of the winch assembly to a wheel.
Figure 3:
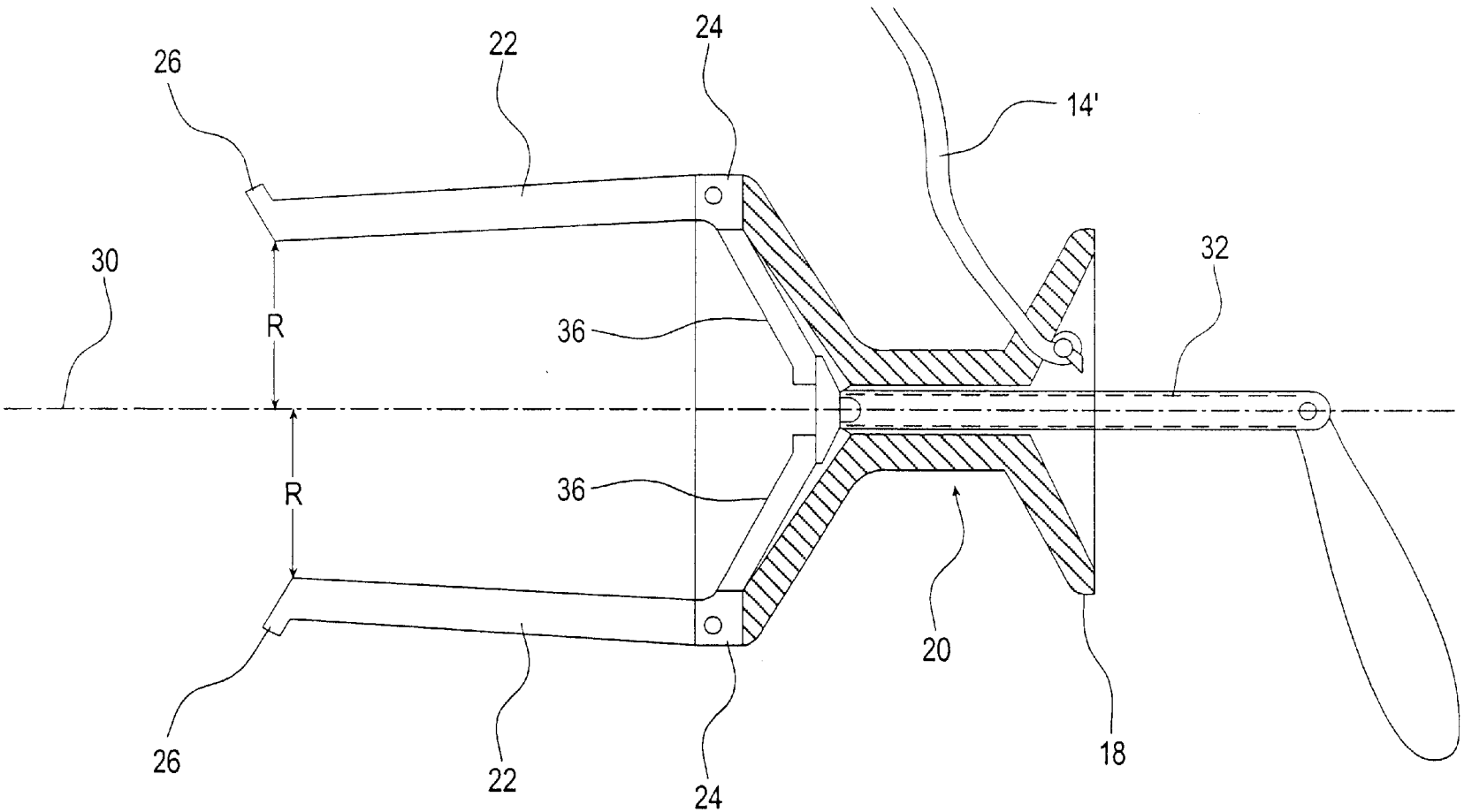
FIG. 3 is a cross-sectional view taken through the winch assembly prior to attachment to a wheel.

Referring now to the drawings, FIGS. 1–3 show a first embodiment of a universal wheel operated winch, generally designated 10, constructed and operative according to the teachings of the present invention, for convenient attachment to a wheel hub 12 so as to draw a cable 14 by rotation of the wheel 16.

Generally speaking, the universal wheel operated winch includes a drum 18 providing a substantially cylindrical outer surface 20 upon which cable 14 is wound. At least three rigid arms 22, each mechanically linked via a pivotal connection 24 to drum 18, each terminate in an end portion 26 configured to engage an edge of an aperture 28 in wheel hub 12. Pivotal connection 24 is configured such that pivoting of arm 22 varies a radial distance R from a central axis 30 of drum 18 to end portion 26 (see FIG. 3).

It will be immediately apparent that the pivoting arms of the device of the present invention provide a simple but elegant solution to the variations in radial positioning of apertures in the hubs of different wheels. This and other advantages of preferred embodiments of the present invention will be better understood from the following detailed description.

Turning now to the features of the present invention in more detail, drum 18 is preferably implemented as a hollow cylinder with flared flanges at each end, thereby providing substantially cylindrical surface 20 bounded by conical cable-guiding surfaces. It should be appreciated that surface 20 need not necessarily be a solid continuous surface, so long as it provides a structure about which a cable can be wound. Thus, possible examples include various open frame structures or sets of parallel rods which provide an effective surface around which the cable may be wound. Surface 20 is described as "substantially cylindrical" only to the extent necessary to provide a suitable surface upon which to wind the cable, and may vary significantly from cylindrical.

The various arms 22 to be employed for engaging a given wheel hub 12 are preferably restrained to a substantially equal radial spacing so as to center drum 18 relative to wheel 16. To this end, a mechanical actuator 32 (best seen in FIG. 3) is associated with drum 22 and configured to act as a clamping mechanism to impose a substantially uniform limitation on the radial distance R of end portion 26 of each of arms 22 from central axis 30. It should be noted that a one-directional limitation on R (i.e., greater than a given value, or less than a given value) is usually sufficient. This allows the arms to be tightened symmetrically against the edges of apertures 28 which themselves provide an opposing limit on the opening or closing movement. Thus, in the example shown here, actuator 32 is configured to displace arms 22 pivotally about connections 24 so as to increase R to at least a given desired value, thereby tightening end portions 26 against the outer edges of apertures 28. This provides an additional effect of locking the winch in place on hub 12 until wheel 16 starts to turn. Once turning, arms 22 may optionally be configured to lock against the side edges of apertures 28 due to the applied torque in a manner similar to the Hobson reference mentioned earlier.

The particular implementation of actuator 32 is not generally critical to the present invention. In the particularly preferred example shown here employs a quick-adjust lever clamp engaged within a central bore through drum 18 and pressing against an inwardly extending actuation lever 36 to provide particularly convenient instant adjustment to the required radial spacing. Clearly, however, a range of other adjustment mechanism could provide a similar function.

In addition to accommodating variations in the radial position of apertures 28, winch 10 preferably also accommodates variations in angular spacing of the apertures around the axis of the wheel. According to a first solution to this problem, best seen in FIG. 2, winch 10 is provided with at least six rigid arms 22, pivotal connections 24 being configured to allow each arm to be selectively pivoted outwards to an inoperative position 34. The inoperative position is chosen, typically projecting radially outwards, such that arm 22 does not interfere with winding of cable 14 onto drum 18 and actuation lever 36 lies between actuator 34 and hub 12.

By way of a preferred example, the winch shown here has six arms 22 including a first group of three of the rigid arms angularly spaced at an angle of substantially 120° to each other around central axis 30 and a second group of the four rigid arms angularly spaced at an angle of substantially 90° to each other. In other words, arms 22 of this example are spaced around central axis 30 at angles of about 0°, 90°, 120°, 180°, 240° and 270°. Thus, for wheels with 3, 6 or 9 apertures 28, the first group of arms are used while the arms not required (three out of four from the second group) are swung up to their inoperative positions. For wheels with 4, 8 or 12 apertures 28, the second group of arms 22 are used. Alternative implementations (not shown here) may be provided with additional, or alternative, sets of arms deployed at multiples of about 72° (for five-fold symmetry) and/or of about 51° (for seven-fold symmetry).

Figure 4:
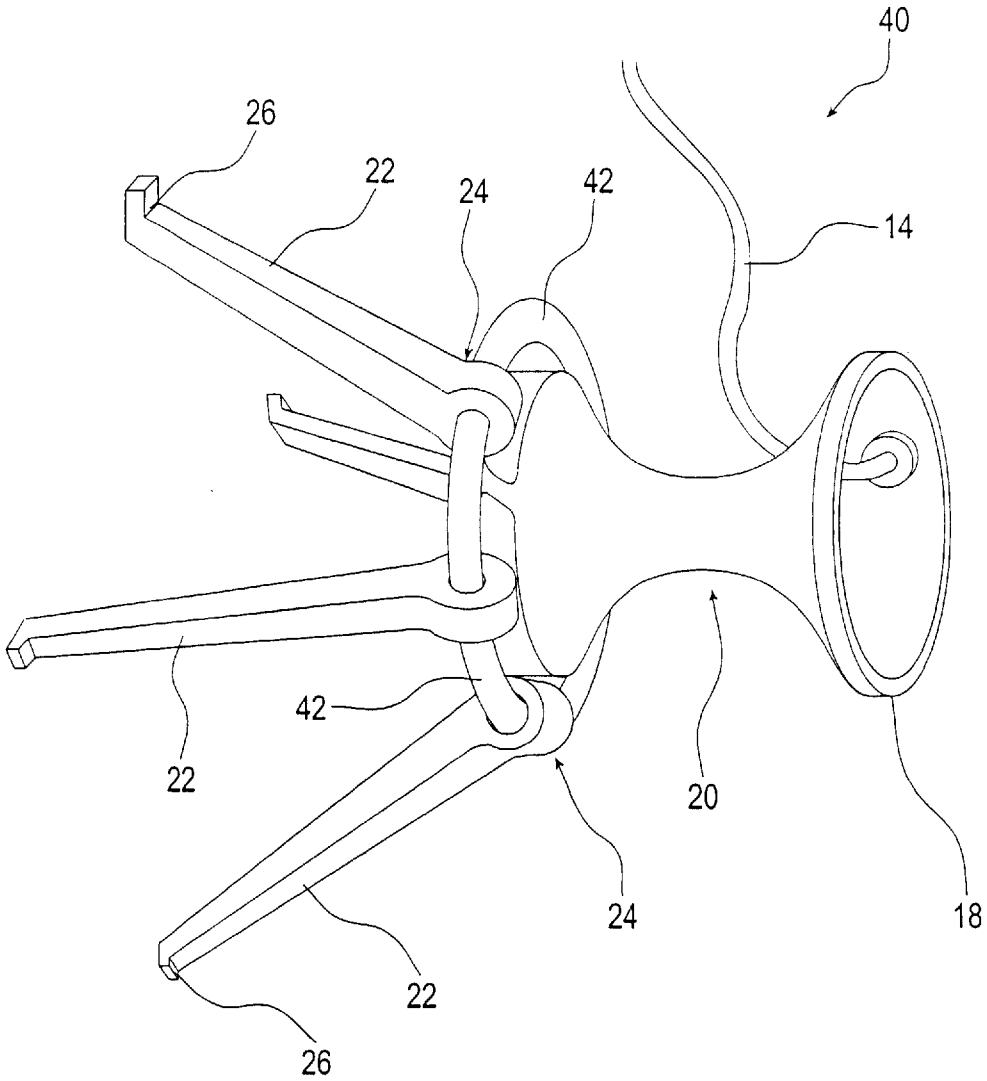
FIG. 4 is an isometric view of an alternative embodiment of the universal wheel operated winch of the present invention.

Turning now to FIG. 4, there is shown an alternative embodiment of a universal wheel operated winch, generally designated 40, constructed and operative according to the teachings of the present invention. Winch 40 is generally similar in structure and function to winch 10, equivalent elements being labeled similarly. Winch 40 differs from winch 10 primarily in that at least some of arms 22 are mounted so as to allow adjustment of their angular position about axis 30, thereby allowing a relatively small number of arms 22 (typically three or four) to suffice for substantially any angular spacing of apertures 28.

Structurally, this embodiment is preferably implemented by mounting of some or all of rigid arms 22 pivotally on one or more arcuate rod 42 which approximates to part of an arc of constant radius about axis 30. Arms 22 are configured to be slidable along arcuate rod 42, thereby permitting adjustment of the angular spacing of the arms about axis 30.

In order to allow pivotal motion about arcuate rod 42, the bore through rigid arms 22 must have an internal diameter which is oversized relative to the thickness of the rod to accommodate the rod's curvature. This size mismatch serves an additional locking function when a torque is applied during use, causing locking of the arms against slippage along rod 42. The principle of this type of locking is well known from slide-adjustable clamps which are used for many applications.

In all other respects, including the operation of actuator 32 (not shown), the structure and operation of winch 40 is analogous to that of winch 10 described above.

It will already be apparent that the present invention offers a simple-to-use universal solution, well suited for supply in a compact kit form, for freeing vehicles stuck in soft terrain. Winches 10 (or 40), preferably provided as a pair, may be mounted on the drive wheels of substantially any vehicle by selecting (or aligning) the arms 22 in the appropriate angular positions, opening them to a spacing aligned with apertures 28, and tightening them lightly against the edges of the apertures. This may be done in a matter of seconds by an unskilled user. Cable 14 is linked to an anchor, such as anchor 50 described below, or alternatively passed around some adjacent fixed object. The wheels of the vehicle are then made to turn, thereby winding cable 14 onto drums 18 and drawing the vehicle towards the anchor until it extracts itself from the soft terrain.

Figure 5:
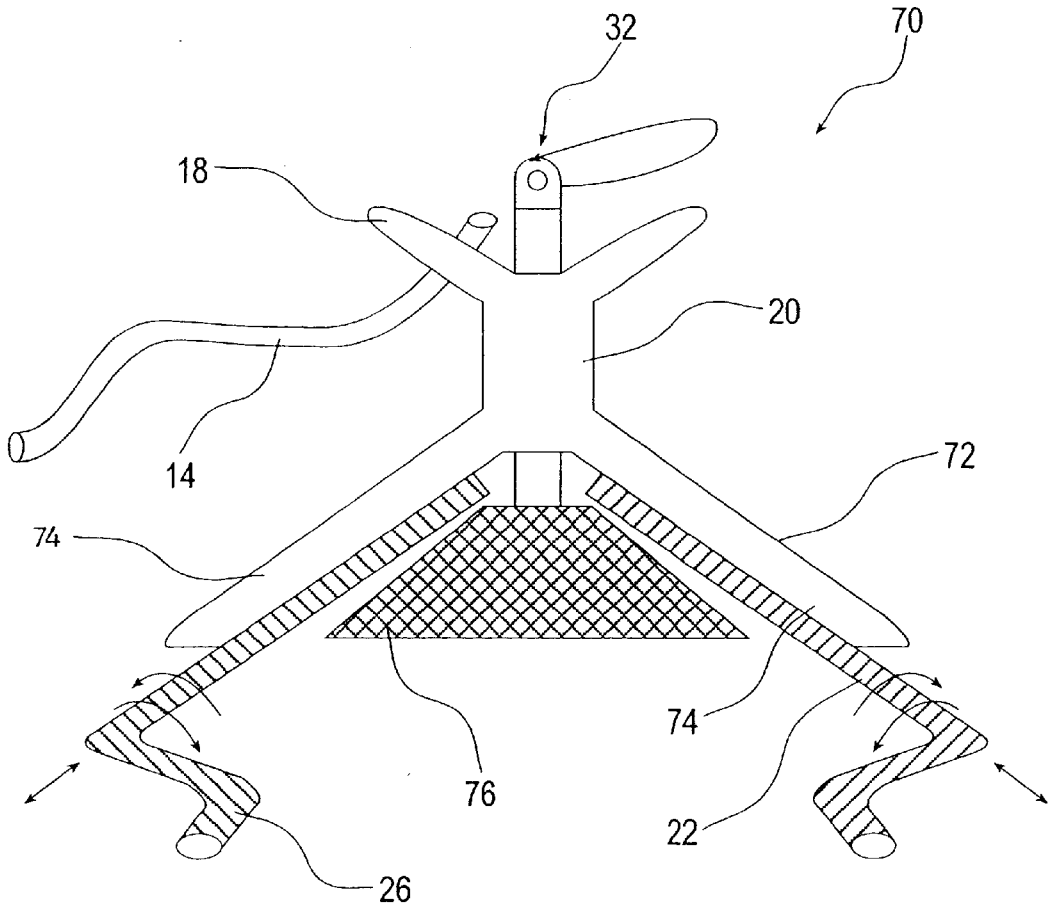
FIG. 5 is a side cross-sectional view taken through a third preferred embodiment of the universal wheel operated winch of the present invention.
Figure 6:
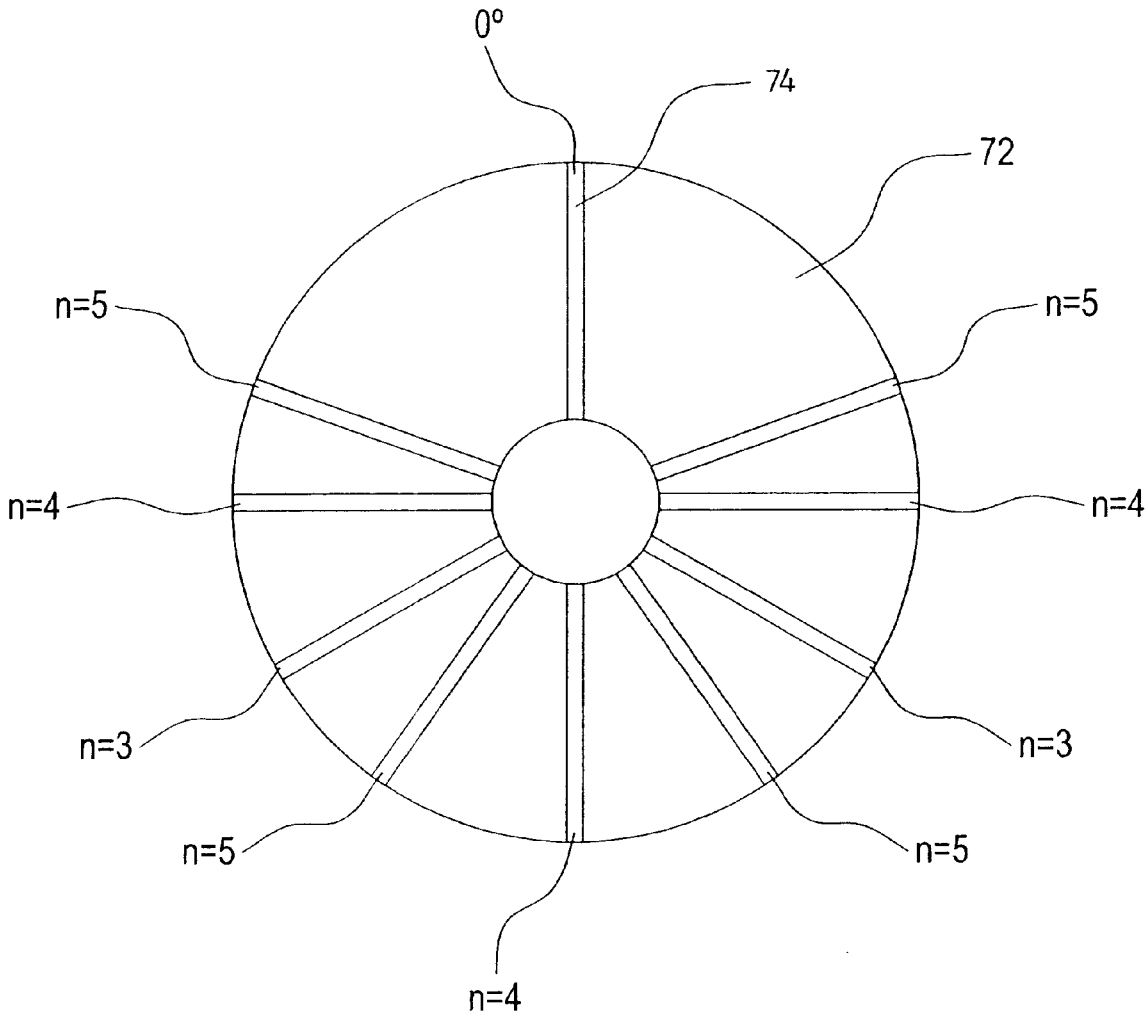
FIG. 6 is an end view of a winch drum from the universal wheel operated winch of FIG. 5.

Turning now to FIGS. 5 and 6, there is shown a third preferred embodiment of a universal wheel operated winch, generally designated 70, constructed and operative according to the teachings of the present invention. As in the previous embodiments, winch 70 includes a drum 18 providing a substantially cylindrical outer surface 20 upon which cable 14 is wound, and at least three rigid arms 22. In this case, however, arms 22 are preferably separate elements, which may be positioned in relation to drum 18 to provide a desired radial spacing and are then clamped in a substantially fixed position relative to the drum by clamping mechanism 32.

In this case, drum 18 preferably features a clamping surface 72 provided with a plurality of substantially radial grooves 74 angularly-spaced about central axis 30 and configured for receiving rigid arms 22. Clamping mechanism 32 preferably includes a complementary clamping block 76 deployed with a surface 78 facing, and selectively closable towards, clamping surface 72 so as to clamp rigid arms 22 within grooves 74.

Clamping surface 72 is preferably substantially conical. In this context, it should be appreciated that grooves 74 are described as "radial" in the sense that their extensional direction roughly intersects axis 30 such that they are radial as viewed along the axis (FIG. 6). Since the grooves are formed across the surface of clamping surface 72, they do not lie in a plane perpendicular to axis 30.

In order to accommodate wheels with a wide range of different patterns of apertures, clamping surface 72 is preferably provided with various sets of radial grooves 74 with different angular spacing. Preferably, two or more sets of grooves 74 are angularly-spaced about axis 30 at multiples of substantially 360°/n for different integer values of n not less than 3. In the example shown here, as best seen in FIG. 6, sets of grooves 74 are provided with n=3 (120° spacing), n=4 (90° spacing) and n=5 (72° spacing). Although omitted here for clarity of presentation, it is generally feasible to include at least one additional set, preferably for n=7, on the same clamping surface 72.

Rigid arms 22 for this implementation are preferably substantially circular in cross-section, and preferably have a Z-shape offset portion at their ends 26. This offset provides an additional range of adjustment of the end portions, prior to tightening of clamping mechanism 32, by turning of each arm 22 about its own longitudinal axis In use, the winch 70 is provided with enough arms 22 for the largest set of grooves 74. According to the symmetry of the wheel to which the winch needs to be attached, the user selects a suitable number of arms 22 and inserts them into the correspondingly labeled set of grooves 74. The winch is then positioned opposite the wheel hub, and the arms are slid along within grooves 74 and/or turned until the Z-shaped end portions 26 engage within the apertures of the wheel. According to a preferred mode of use, the winch is then pushed gently towards the wheel, thereby causing each arm 22 to retract along its groove 74 as far as possible. This action automatically aligns winch 70 in a central symmetrical position relative to the wheel. The tightening mechanism 32 is then actuated, thereby closing surface 78 of clamping block 76 towards surface 72 so as to fix the positions of arms 22 within grooves 74. Advantageously, if tightening is not overdone, any slight misalignment leading to uneven distribution of the loads applied to the different arms 22 tends to equal out due to slight rotation of arms 22 within the grooves, giving a self-centering effect. Winch 70 is then ready for operation in a similar manner to winches 10 and 40 described above.

Figure 7:
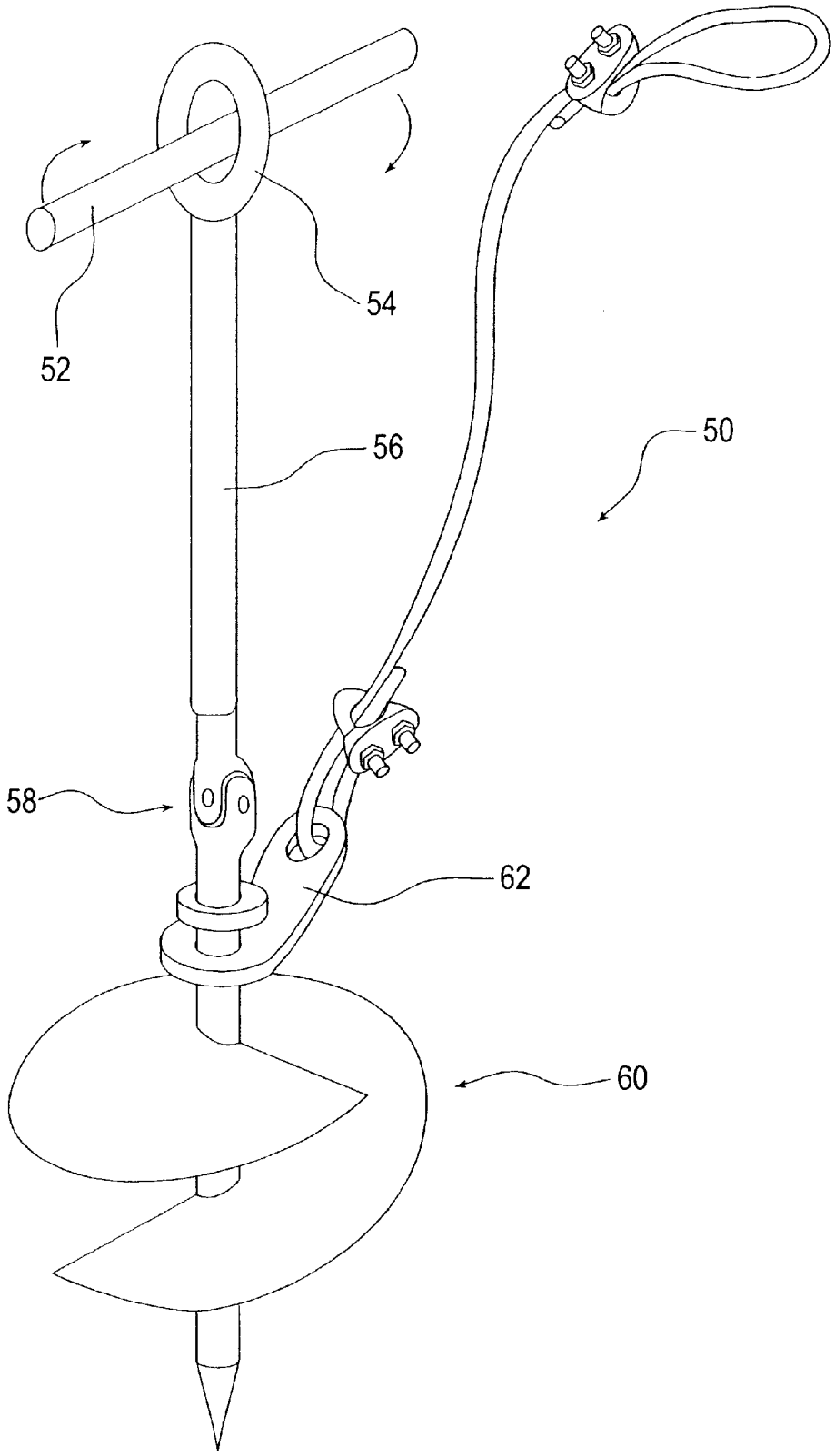
FIG. 7 is an isometric view of a preferred implementation of a self-drilling anchor for use with the universal wheel operated winch of the present invention.

Brief reference is now made to FIG. 7 which shows a preferred form of a self-drilling anchor 50 for use with the present invention to anchor cable 14 in soft terrain. Anchor 50 may be turned by insertion of a bar 52 through an eye 54 formed in the end of a torque shaft 56 which is liked by a universal torque-transmitting coupling 58 to the self-drilling portion 60 of the anchor. A rotatable bracket 62 is provided for cable attachment adjacent to self-drilling portion 60 and below coupling 58, so as to minimize the moment applied on portion 60 by tension in the cable.

It will be appreciated that the above descriptions are intended only to serve as examples, and that many other embodiments are possible within the spirit and the scope of the present invention.

What is claimed is:

1. A universal wheel operated winch for attachment to a wheel hub so as to draw a cable by rotation of the wheel, the universal wheel operated winch comprising:

(a) a drum providing a substantially cylindrical outer surface configured for receiving a cable wound thereupon, said drum having a central axis;

(b) at least three rigid arms, each terminating in an end portion configured to engage an edge of an aperture in a wheel hub, said rigid arms adjustably cooperating with said drum such that a radial distance from said end portion to said central axis may be varied; and (c) a clamping mechanism, associated with said drum, and configured to selectively clamp said rigid arms in a substantially fixed position relative to said drum.

2. The universal wheel operated winch of claim 1, wherein said drum features a clamping surface provided with a plurality of substantially radial grooves angularly-spaced about said axis and configured for receiving said rigid arms, and wherein said clamping mechanism includes a clamping block deployed with a surface facing, and selectively closable towards, said clamping surface so as to clamp said rigid arms within said radial grooves.

3. The universal wheel operated winch of claim 2, wherein said clamping surface is substantially conical.

4. The universal wheel operated winch of claim 2, wherein said plurality of substantially radial grooves includes sets of radial grooves angularly-spaced about said axis at multiples of substantially 360°/n for at least two different integer values of n not less than 3.

5. The universal wheel operated winch of claim 2, wherein each of said rigid arms has a substantially circular cross-section.

6. The universal wheel operated winch of claim 1, wherein each of said rigid arms is mechanically linked to said drum via a pivotal connection.

7. The universal wheel operated winch of claim 6, wherein said clamping mechanism is configured to impose a substantially uniform limitation on the radial distance of said end portion for each of said arms from said central axis.

8. The universal wheel operated winch of claim 6, wherein said clamping mechanism is configured to displace said at least three rigid arms pivotally about said pivotal connections to positions in which said end portion for each of said arms is at least a given minimum radial distance from said central axis.

9. The universal wheel operated winch of claim 6, wherein said at least three rigid arms are implemented as at least six rigid arms, said pivotal connections being configured to allow each of said rigid arms to be selectively pivoted to an inoperative position.

10. The universal wheel operated winch of claim 9, wherein said at least six rigid arms includes a first group of three of said rigid arms angularly spaced at an angle of substantially 120° to each other and a second group of said four rigid arms angularly spaced at an angle of substantially 90° to each other.

11. The universal wheel operated winch of claim 6, wherein said pivotal connection of at least one of said rigid arms is implemented by pivotal mounting of said rigid arm on an arcuate rod which approximates to an arc of constant radius about said central axis, said at least one rigid arm being slidable along said arcuate rod, thereby permitting adjustment of an angular spacing between at least two of said rigid arms about said central axis.

12. A universal wheel operated winch for attachment to a wheel hub so as to draw a cable by rotation of the wheel, the universal wheel operated winch comprising:

(a) a drum providing a substantially cylindrical outer surface configured for receiving a cable wound thereupon, said drum having a central axis; and (b) at least three rigid arms, each mechanically linked via a pivotal connection to said drum and terminating in an end portion configured to engage an edge of an aperture in a wheel hub, said pivotal connection being configured such that pivoting of said rigid arm varies a radial distance from said central axis to said end portion.

13. The universal wheel operated winch of claim 12, further comprising a mechanical actuator associated with said drum and configured to impose a substantially uniform limitation on the radial distance of said end portion for each of said arms from said central axis.

14. The universal wheel operated winch of claim 12, further comprising a mechanical actuator associated with said drum and configured to displace said at least three rigid arms pivotally about said pivotal connections to positions in which said end portion for each of said arms is at least a given minimum radial distance from said central axis.

15. The universal wheel operated winch of claim 12, wherein said at least three rigid arms are implemented as at least six rigid arms, said pivotal connections being configured to allow each of said rigid arms to be selectively pivoted to an inoperative position.

16. The universal wheel operated winch of claim 15, wherein said at least six rigid arms includes a first group of three of said rigid arms angularly spaced at an angle of substantially 120° to each other and a second group of said four rigid arms angularly spaced at an angle of substantially 90° to each other.

17. The universal wheel operated winch of claim 12, wherein said pivotal connection of at least one of said rigid arms is implemented by pivotal mounting of said rigid arm on an arcuate rod which approximates to an arc of constant radius about said central axis, said at least one rigid arm being slidable along said arcuate rod, thereby permitting adjustment of an angular spacing between at least two of said rigid arms about said central axis.

18. A universal wheel operated winch for attachment to a wheel hub so as to draw a cable by rotation of the wheel, the universal wheel operated winch comprising:

(a) a drum providing a substantially cylindrical outer surface configured for receiving a cable wound thereupon, said drum having a central axis;

(b) at least one arcuate rod, rigidly interconnected with said drum said at least one arcuate rod approximating to at least one arc from a virtual circle of constant radius about said central axis; and (c) at least three rigid arms mechanically inked to said drum and terminating in an end portion configured to engage an edge of an aperture in a wheel hub, at least two of said rigid arms being mounted so as to be slidable along said at least one arcuate rod, thereby permitting adjustment of an angular spacing between at least two of said rigid arms about said central axis.

19. The universal wheel operated winch of claim 18, wherein each of said at least three rigid arms is mechanically linked to said drum via a pivotal connection configured such that pivoting of said rigid arm varies a radial distance from said central axis to said end portion.

20. The universal wheel operated winch of claim 19, further comprising a mechanical actuator associated with said drum and configured to impose a substantially uniform limitation on the radial distance of said end portion for each of said arms from said central axis.

21. The universal wheel operated winch of claim 19, further comprising a mechanical actuator associated with said drum and configured to displace said at least three rigid arms pivotally about said pivotal connections to positions in which said end portion for each of said arms is at least a given minimum radial distance from said central axis.

* * * * *